US006854798B1

(12) United States Patent
Mason et al.

(10) Patent No.: US 6,854,798 B1
(45) Date of Patent: Feb. 15, 2005

(54) BLEACHER CHAIR AND METHOD OF VENDING SAME

(76) Inventors: Thomas Mason, 1616 W. Walnut Ave., Vineland, NJ (US) 08360; Rosetta Mason, 1616 W. Walnut Ave., Vineland, NJ (US) 08360

( * ) Notice: Subject to any disclaimer, the term of this patent is extended or adjusted under 35 U.S.C. 154(b) by 168 days.

(21) Appl. No.: 09/716,156

(22) Filed: Nov. 20, 2000

(51) Int. Cl.[7] ..... A47C 13/00; A47D 1/04

(52) U.S. Cl. ..... 297/39; 297/252; 297/134; 297/352

(58) Field of Search ..... 297/39, 252, 352; 705/2; 235/381, 383, 385; 186/53, 55, 61; 340/572.1

(56) References Cited

U.S. PATENT DOCUMENTS

| | | | | | |
|---|---|---|---|---|---|
| 226,156 | A | | 4/1880 | Blackler | |
| 243,617 | A | | 6/1881 | Porter | |
| 720,034 | A | | 2/1903 | Kerr | |
| 2,528,433 | A | | 10/1950 | Hines | |
| 2,694,441 | A | * | 11/1954 | Degenfelder | |
| 3,094,358 | A | * | 6/1963 | Hartman | 297/452.64 |
| 3,114,572 | A | * | 12/1963 | Hopkins | 297/33 |
| 3,167,790 | A | | 2/1965 | Hickey | |
| 3,405,972 | A | | 10/1968 | Morris | |
| 3,594,039 | A | * | 7/1971 | Harp | 297/252 |
| 3,994,529 | A | * | 11/1976 | Lippert | 297/252 |
| 4,073,368 | A | * | 2/1978 | Mustapick | 186/53 |
| 4,536,026 | A | * | 8/1985 | Cornell | 297/39 |
| 4,550,246 | A | * | 10/1985 | Markman | 235/385 |
| 4,675,515 | A | * | 6/1987 | Lucero | 235/381 |
| 4,676,343 | A | * | 6/1987 | Humble et al. | 186/61 |
| 4,772,068 | A | * | 9/1988 | Gleckler et al. | 297/39 |
| 4,842,329 | A | | 6/1989 | Owens | |
| 5,186,281 | A | * | 2/1993 | Jenkins | 186/55 |
| 5,326,152 | A | | 7/1994 | Baron | |
| 5,494,333 | A | * | 2/1996 | Wilson | 297/344.18 |
| 5,516,193 | A | | 5/1996 | Simpson | |
| 5,829,837 | A | | 11/1998 | Reiersen | |
| 6,203,108 | B1 | * | 3/2001 | Mattison, Jr. | 297/352 |
| 6,206,462 | B1 | * | 3/2001 | Huang | 297/39 |
| 6,213,545 | B1 | * | 4/2001 | Chun-Yueh | 297/39 |

OTHER PUBLICATIONS

Bill Clinton, "Clinton on Signing Electronic Signatures Act." Jun. 30, 2000, U.S. Department of State: International Information Programs, pp. 1–6.*

Sudbury Taylor Rental, renting since Oct. 1, 1971, pp. 1–4, http://www.sudburytaylor.com.*

2002 Georgia Film & Video Sourcebook, "Table and Chair rentals." renting since 1983, pp. 1–2,http://www.telefilm–south.com/Georgia/GAG/7250.shtml.*

Outdoor Aluminum Company, N/A, Outdoor Aluminum (brochure), Jul. 7, 2000 or unknown, All.

N/A, Outdoor Aluminum Company, Geneva, Alabama 36340 U.S.A.

Financial Times, Radio ID tags spread waves of anger among privacy activists, Financial Times.

(Newspaper), Weekend Mar. 1/Mar. 2, 2003, p. 22, unknown, USA.

* cited by examiner

*Primary Examiner*—Peter M. Cuomo
*Assistant Examiner*—Stephen D'Adamo
(74) *Attorney, Agent, or Firm*—William L. Muckelroy; Art Lessler; Gary Lipson

(57) ABSTRACT

A bleacher chair for use with a bleacher structure having tiers of bleacher seating of a standard width, said bleacher chair comprising a chair portion, two lateral arm members, a forward member, and a rearward member and wherein the chair portion can rest upon a bleacher seat, and the rearward member does not contact the bleacher structure in a way which would interfere with the placement of the chair portion upon a bleacher seat. A method for vending the bleacher chair of the present invention to those attending events with bleacher seating is also provided.

15 Claims, 3 Drawing Sheets

BLEACHER CHAIR AND METHOD OF VENDING SAME

CROSS REFERENCE TO RELATED APPLICATIONS

None

STATEMENT REGARDING FEDERALLY SPONSORED RESEARCH OR DEVELOPMENT

None

BACKGROUND OF THE INVENTION

1. Field of the Invention

The present invention relates to bleacher seating, and in particular, the present invention relates to a bleacher chair for use with a bleacher structure having tiers of bleacher seating. In addition, the present invention relates to vending such bleacher chairs at an event with bleacher seating.

2. Description of Related Art

Commercial auditoriums and sports arenas have come to provide comfortable seating for expensive concerts and professional-level sporting events. Local and regional events, such as high school and college football games and other sporting events, however, have not been able to provide such luxury. Fans at such events are rarely provided with more than bleacher seating, which has typically consisted of little more than rough wooden planks on a metal framework or concrete stands. In recent years, standard aluminum bleachers have replaced such older designs, but have not added appreciably to the comfort provided.

Bleacher seating is almost universally uncomfortable, and often wet and cold, particularly when the bleachers are outdoors. Aluminum seating has, if anything, aggravated the perceived coldness of the seating. Worse, bleacher seating provides no back support whatsoever. For those with even minor back problems, watching an event from bleacher seating can prove to be an uncomfortable, if not painful, experience.

Many stadiums and sports arenas rent pillows and padded seating to patrons, but even where such cushioning is available, the support problems are simply not addressed. For many years, the prior art has attempted to overcome these shortcomings, but with limited success.

Aluminum bent tube lawn chairs with plastic strip webbing are manufactured in large quantities for sale in the U.S. Numerous manufacturing plants exist to manufacture these ubiquitous chairs for perpetual sale in the U.S. and other countries. The manufacturing process is so well defined and so well executed that the cost of making these types of chairs is estimated to be about one or two dollars. Utilization of this manufacturing capacity is a key to rapid deployment of the novel improvement disclosed herein.

Numerous patents have been issued which evidence many attempts to commercialize and mass market a bleacher chair without any significant market penetration or mass sale of the patented items. For example, some of these patented structures which failed to create a substantial market are as follows:

U.S. Pat. No. 226,156, issued to Blackler on Apr. 6, 1880. This reference is entitled Window-hair, and shows a seat or chair provided with arms and a back that can be used by persons when washing windows.

U.S. Pat. No. 243,617, issued to Porter on Jun. 28, 1881. This reference is entitled Chair for Attaching to Door Steps, and shows a chair or seat adapted to be secured to the curb or side wall of a flight of door-steps, which can be folded compactly for storage or shipment.

U.S. Pat. No. 720,034, issued to Kerr on Feb. 10, 1903. This reference is entitled Swing Attachment and shows a chair attachment for swings adapted to rope swings with wooden seats and capable of affording a back and footrest and being readily adjusted to accommodate to the person using the swing.

U.S. Pat. No. 2,528,433, issued to Hines on Oct. 31, 1950. This reference is entitled Portable Folding Seat, and is assigned of record to the W. B. Hines Research and Development Corporation of Ohio. The reference shows a portable, folding seat which may be easily carried by the user and which may be readily clamped in place upon the ordinary seat in stadiums and similar places providing a dry comfortable cushion seat having a back rest thereon.

U.S. Pat. No. 2,694,441, issued to Degenfelder on Nov. 16, 1954. This reference is entitled Portable Seat, and shows a portable seat that is equipped with a back collapsible below the seat and collapsible means for securely attaching the seat to a bench.

U.S. Pat. No. 3,167,790, issued to Hickey on Feb. 2, 1965. This reference is entitled Invalid Bed Seat, and shows a seat portion for a chair that can be positioned under a bed-ridden patient and used to move the patient. The patient can be raised to a sitting position and a removable backrest attached to the seat portion.

U.S. Pat. No. 3,405,972, issued to Morris on Oct. 15, 1968. This reference is entitled Stair Chair, and shows a chair having left and right hand leg braces of different lengths so that the chair can be placed on a flight of stairs to permit the user to sit facing a banister with the user's feet on either of two steps upon which the chair is mounted. The chair is collapsible, and can be locked in its erected condition and held in sockets provided therefore on a wall opposite the banister.

U.S. Pat. No. 4,842,329 was issued to Owen on Jun. 17, 1989 for a portable, foldable seating device having a seat and backrest pivotally connected to one another. A U-shaped support is pivotally attached to the seat and in a stored position the back and seat engage in a generally parallel abutting relationship with the support extending to provide a carrying handle. In the use-position as a seat, the support secures the back in a generally vertical position with respect to the seat. The seat may be used with the backrest upright on a relatively flat surface or may be inverted with the backrest serving as a support leg and the bottom of the cushion upwardly facing to provide a seating surface on an incline or hillside.

U.S. Pat. No. 5,326,152 was issued to Baron on Jul. 5, 1994 for a cover for a folding lawn chair provided to allow a person to conveniently carry the folding lawn chair as well as to increase comfort when the person is using the lawn chair. The cover may include an enveloped or flapped portion on each end into which each end of the lawn chair can be situated. The cover thus remains in position on the lawn regardless of wind and movement by the user. The cover further includes a strap to accommodate convenient carrying of the lawn chair. The cover may finally include a pillow positioned at the head portion of the cover, a pocket for carrying magazines and oth er accessories, and an insulated receptacle for carrying and holding beverages such as soda and beer.

U.S. Pat. No. 5,516,193 was issued to Simpson on May 14, 1996 for a portable stadium seat apparatus and is comprised of an apparatus designed to be used at spectator events where the seating is flat benches without backs. The apparatus consists, in one embodiment, of a streamlined fabric unit which folds readily into a compact flat pad or rolls up to fit a pocket while providing a padded seat and a vertical back support portion. The more detailed embodiment is a multi-compartment shoulder bag having a similar padded seat and a vertical back support portion and a storage compartment which extends from the seat when the unit is in position on the bench, and a storage compartment which is behind the backrest when the unit is in position. The webbing is attached to a hook that secures the seat to the front edge of the bench. The webbing goes across the bench and over the back edge. A compression member is inserted into a pocket in the webbing to form a rear edge for the seat at the back of the bench. Pressure from the compression member wraps the seat snugly over the back of the bench, adjusting it in so doing to any standard bench. The compression member extends vertically to the top of the back of the seat and is attached thereto. Adjustment devices are attached to the webbing to permit the user to adjust the angle of the backrest.

U.S. Pat. No. 5,829,837 was issued to Reiersen on Nov. 3, 1998 for a portable back and arm support device for use on a bleacher-type bench seat which incorporates a simple back support and two arm supports hingedly connected to the back support. Each arm support may be folded inward so that each arm support is in a parallel relationship with the back support as well as with each other in a tight, transportable arrangement, or each arm support may be folded outward in its operation position so that each arm support is in a somewhat perpendicular relationship with the back support. Each arm support contains a unique fulcruming arrangement which allows the arm supports to constrict, thereby attaching to, or "grasping" onto a bench-type seat by fastening to the mere edges of such bench-type seat.

SUMMARY OF THE INVENTION

Objects of the Present Invention

It is an object of the present invention to provide a collapsible, portable bleacher chair that will help to isolate the occupant from the coldness and dampness problems commonly associated with bleacher seating.

However, the primary object of the invention is a structural design adapted as a clever and simple improvement of the standard plastic web strip aluminum lawn chair which converts it into a very stable stadium or bleacher chair with an integral seat and the readly capacity to take advantage of all of the manufacturing plants and distribution and marketing channels for the aluminum plastic web chair already in place.

It is a further object of the present invention to provide a collapsible, portable bleacher chair made from a novel and clever modification of an aluminum frame web lawn chair that will provide back support, a seat, arm rests and an elevated footrest for an occupant.

However, the invention must be easily commercialized to be successful in the marketplace and mass marketable and thus it is a still further object of the present invention to provide a method of vending the bleacher chair of the present invention to those attending events for which bleacher seating is provided.

According to the present invention, there is provided a collapsible, portable bleacher chair for use with a bleach er structure having tiers of bleacher seating of a standard width, said bleacher chair comprising a chair portion comprising:

an elongated rod;

a seat portion comprising a peripheral frame forming two opposed sides and one unopposed side of a rectangle, and flexibly joined with said elongated rod to form the fourth side thereof;

a back portion comprising a peripheral frame forming two opposed sides and one unopposed side of a rectangle, and flexibly joined with said elongated rod to form the fourth side thereof; and, a seating surface, comprising a tightly interwoven mesh of woven plastic straps, such that, straps connect the opposed sides of said seat portion frame, the opposed sides of said back portion frame, and the unopposed side of said seat portion frame to the unopposed side of side back portion frame across said elongated rod;

two lateral arm members positioned outward of said chair portion, one on each side, with each rearward end of each arm member flexibly joined to the opposing sides of said back portion frame of said chair portion approximately at their midpoint;

a forward member comprising a frame forming two opposed sides and one unopposed side of a rectangle, with each distal end of said opposed sides farthest from said unopposed side flexibly joined to one of the lateral arm members in the proximity of the forward end thereof, and the opposed sides of said forward member flexibly joined approximately at their midpoint to the opposing sides of said seat portion frame in the proximity of the unopposed side of said seat portion frame; and, a rearward member comprising a peripheral frame forming two opposed sides and one unopposed side of a rectangle, with each distal end of said opposed sides farthest from said unopposed side flexibly joined to one of the lateral arm members in the proximity of the midpoint of said lateral arm members, and the opposed sides of said rearward member flexibly joined at a point proximate to the unopposed side of said rearward member to the opposed sides of said seat portion frame in the proximity of the distal ends of said opposed sides of said seat portion frame farthest from the unopposed side of said seat portion frame member, and wherein, the distance between the juncture of said forward member with said seat portion frame and the juncture of said rearward member with said seat portion frame is greater than the standard width of bleacher seating, such that said seat portion frame can rest upon said bleacher seating, and wherein, the portion of said rearward member extending beyond the junction of said rearward member with said seat portion frame does not contact a bleacher structure in a way, which would interfere with the placement of the seat portion frame upon a bleacher seat.

According to another embodiment of the present novel invention, there is provided a method for the rental of a collapsible, portable bleacher chair for events having bleacher seating to a customer attending said event, which method comprises: having a supply of collapsible, portable bleacher chairs at a convenient location proximate to said event; providing a bleacher chair to a customer for the time period of the event upon payment of a rental fee and provision of a security; and, returning said security to said customer upon return of the bleacher chair.

In summary, the inventors have discovered that by modifying a standard aluminum lawn chair of the type with plastic webbing at the rear support legs or rear U-shaped support in a specified manner, i.e. shortening same to a specified length, namely to 14 inches from the standard 20 inches combined with placing and combining the chair on top of a bleacher seat having a width of approximately 12 inches or less, and a novel structure is created which provides a much desired elevated foot rest which elevates the feet of a user above the bleacher floor support by several inches which eliminates the need to extend the users feet to the seat of the bleacher directly in front on the next tier down. This foot rest combined with the back support provided by the chair provides a substantially increased level of ergonomic comfort not heretofore available in stadium or bleacher seating.

And, when the rear U-shaped leg support is shortened this change inherently creates an advantageous unobstructed space for the legs of the spectator directly behind the novel bleacher chair user.

That the foregoing and other features and advantages of the present invention are evident upon a prima facie application of the doctrine of equivalents will be appreciated as the novel invention is better understood from the detailed description of its novel aspects, as further disclosed herein, when taken in conjunction with the following drawings, wherein.

DETAILED DESCRIPTION OF THE INVENTION

Figure 1:
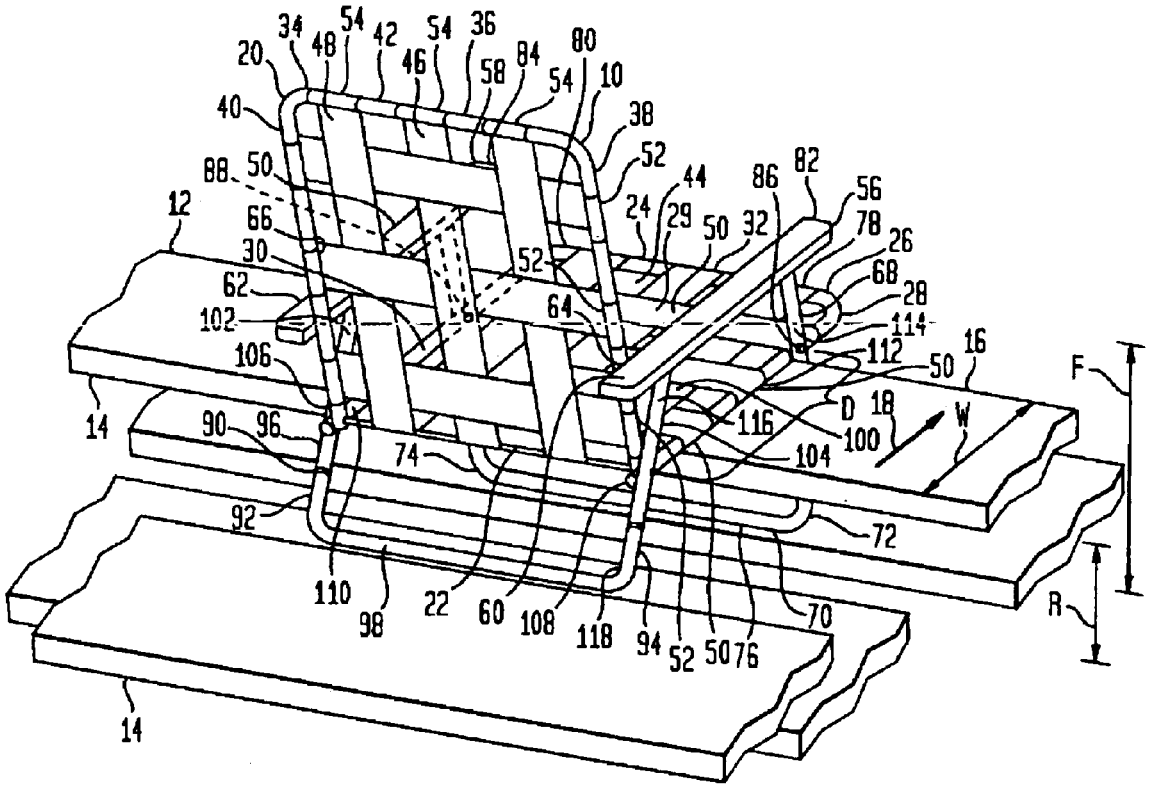
FIG. 1 is a perspective view of the collapsible, portable bleacher chair of the present invention, in place on bleacher seating in a bleacher structure.

FIG. 1 is a perspective view of the collapsible, portable bleacher chair 10 of the present invention. The bleacher chair 10 is intended for use with a bleacher structure 12 having tiers 14 of bleacher seating 16 of a standard width 18. The bleacher chair 10 comprises a chair portion 20 that is constructed of a number of components, including an elongated rod 22. The chair portion 20 further comprises a seat portion 24 comprising a peripheral frame 26 forming two opposed sides 28 and 30 and one unopposed side 32 of a rectangle, and flexibly joined with the elongated rod 22 to form the fourth side thereof.

The chair portion 20 further comprises a back portion 34 comprising a peripheral frame 36 forming two opposed sides 38 and 40 and one unopposed side 42 of a rectangle, and flexibly joined with the elongated rod 22 to form the fourth side thereof.

The chair portion 20 further comprises a seating surface 44. This is typically a tightly interwoven mesh 46 of woven plastic straps 48, but cloth fabric, in the form of strips or panels, can serve the same purpose. It is intended that this is done in such a way that straps 50 connect the opposed sides 28 and 30 of the seat portion 24 frame 26. Straps 52 connect the opposed sides 38 and 40 of the back portion 34 frame 36. Straps 54 connect the unopposed side 32 of the seat portion 24 frame 26 to the unopposed side 42 of back portion 34 frame 36 across the elongated rod 22.

The bleacher chair 10 of the present invention further comprises two lateral arm embers 56 and 58. These arm members 56 and 58 are positioned outward of the chair portion 20, one on each side, with each rearward end 60 and 62 of each arm member 56 and 58 and are flexibly joined to the opposing sides 40 and 42 of the back portion 34 frame 36 of the chair portion 20 approximately at their midpoints 64 and 66.

The bleacher chair 10 of the present invention further comprises a forward member 68 that comprises a frame 70 forming two opposed sides 72 and 74 and one unopposed side 76 of a rectangle. Each distal end 78 and 80 of the opposed sides 72 and 74 farthest from the unopposed side 76 are flexibly joined to one of the lateral arm members 56 and 58 in the proximity of the forward ends 82 and 84 thereof. Further, the opposed sides 72 and 74 of the forward member 68 are flexibly joined approximately at their midpoints 86 and 88 to the opposing sides 28 and 30 of the seat portion 24 frame 26 in the proximity of the unopposed side 32 of the seat portion 24 frame 26.

In addition, the bleacher chair 10 of the present invention further comprises a rearward member 90 comprising a frame 92 forming two opposed sides 94 and 96 and one unopposed side 98 of a rectangle. Each distal end 100 and 102 of the opposed sides 94 and 96 farthest from the unopposed side 98 are pivotably joined to one of the lateral arm members 56 and 58 in the proximity of the midpoints 104 and 106 of the lateral arm members 56 and 58, and the opposed sides 94 and 96 of the rearward member 90 are flexibly joined at a point proximate to the unopposed side 98 of the rearward member 90 to the opposed sides 28 and 30 of the seat portion 24 frame 26 in the proximity of the distal ends 108 and 110 of the opposed sides 28 and 30 of the seat portion 24 frame 26 farthest from the unopposed side 32 of the seat portion 24 frame 26.

This construction is intended to provide a distance 112 which is a proximately an inch or two more than the width of the bleacher seat 16, between the juncture 114 of the forward member 68 with the seat portion 24 frame 26 and the juncture 116 of the rearward member 90 with the seat portion 24 frame 26 that is greater than the standard width 18 of bleacher seating 16. In this manner, the collapsible, portable bleacher chair 10 of the present invention is constructed such that the seat portion 24 frame 26 can rest upon the bleacher seating 16. Critical to this, however, is the requirement that the portion 118 of the rearward member 90 extending beyond the junction 116 of the rearward member 90 with the seat portion 24 frame 26 does not contact the bleacher structure 12 in a way which would interfere with the placement of the seat portion 24 tubular frame 26 upon the bleacher seating 16. The inventors have discovered that the optimum length for the sides 94 and 96 is in the range from about 14 inches to about 16 inches.

Figure 2:
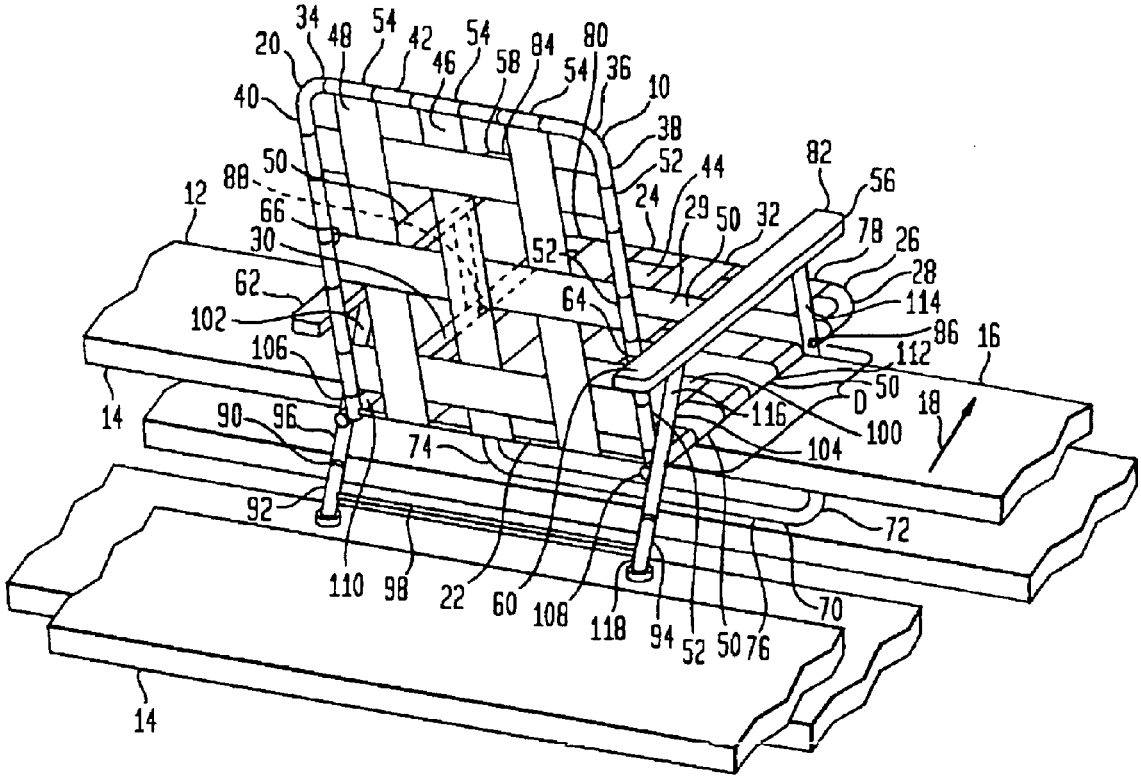
FIG. 2 is another view of the collapsible, portable bleaches chair of the present invention, showing greater detail of the rearward member in relation to a bleacher structure.

In FIGS. 1 and 2 there is shown a distance D between the junction 114 of said forward member 68 with said seat portion 24 and the junction 116 of said rearward member 90 with said seat portion 24. The distance D is greater than the width W of the bleacher seat plank or tier 14. The seat portion 24 rests upon the tier 14. Thus, the bleacher chair 10 is supported solely by the tier 14. The distance R is substantially (approximately one-third) less than the distance F, shown in FIG. 1. The forward member 68 is part of the frame 70. The frame 70 is formed of two opposed forward vertically oriented and forward slanted sides 72 and 74 each having the length F, the length F representing the length of these forward slanted sides 72 and 74. The rearward member 90 comprises the frame 92, which is formed of two opposed rearward vertically oriented and rearward slanted sides 94 and 96 each having a length R, the length R representing the length of each of the rearward members, namely, the rearward slanted sides 94 and 96. The unopposed side 76 is a horizontal bar that provides a suspended foot rest behind a bleacher seating plank in front of the bleacher seating plank or tier 14 on which the bleacher chair 10 rests.

FIG. 2 is another view of the collapsible, portable bleacher chair 10 of the present invention, showing greater detail of the rearward member 90 in relation to a bleacher structure 12. In the embodiment shown in FIG. 2, the rearward member 90 frame 92 comprises separated pieces, with the opposed sides 94 and 96 formed of tubular aluminum, and the unopposed side 98 formed of a solid metal rod.

One skilled in the art will recognize the similarity between the collapsible, portable bleacher chair 10 of the present invention and a common folding lawn chair. However, such a folding lawn chair would not be suitable for the present purposes because the rear legs of a common lawn chair would interfere with the bleacher structure, and the seat portion would not be able to rest on the bleacher seating. There are forms of folding chairs with shorter rear legs, commonly referred to as beach chairs, but these constructions are intended for a more recumbent position on a relatively level surface, and would similarly not serve the present purpose.

The collapsible, portable bleacher chair 10 of the present invention can be constructed of numerous materials, including wood, solid metal, tubular metal, and the like. In the presently preferred embodiment of the invention, however, the elongated rod 22 is preferably constructed of solid metal, while the seat portion 24 frame 26, the back portion 34 frame 36, the forward member 68 frame 70, and the rearward member 90 frame 92 are each constructed of an integrally formed piece of tubular aluminum.

Figure 3:
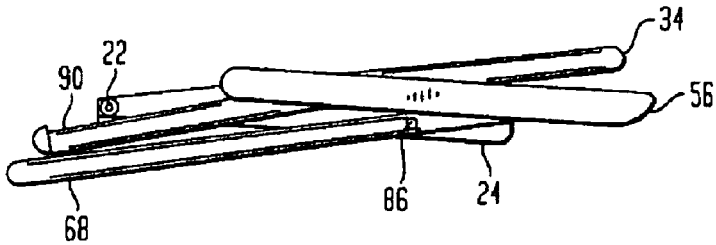
FIG. 3 shows the collapsible, portable bleacher chair of the present invention in its collapsed state, for transport or storage.

FIG. 3 shows the novel collapsible, portable bleacher chair of the present invention in its collapsed state, for transport or storage.

According to another embodiment of the present novel invention, there is provided a method for the rental of the collapsible, portable bleacher chair 10 for events having bleacher seating to a customer attending said event, which method comprises having a supply of collapsible, portable bleacher chairs at a convenient location proximate to said event; providing a bleacher chair to a customer for the time period of the event upon payment of a rental fee and provision of a security; and, returning said security to said customer upon return of the bleacher chair.

Figure 4:
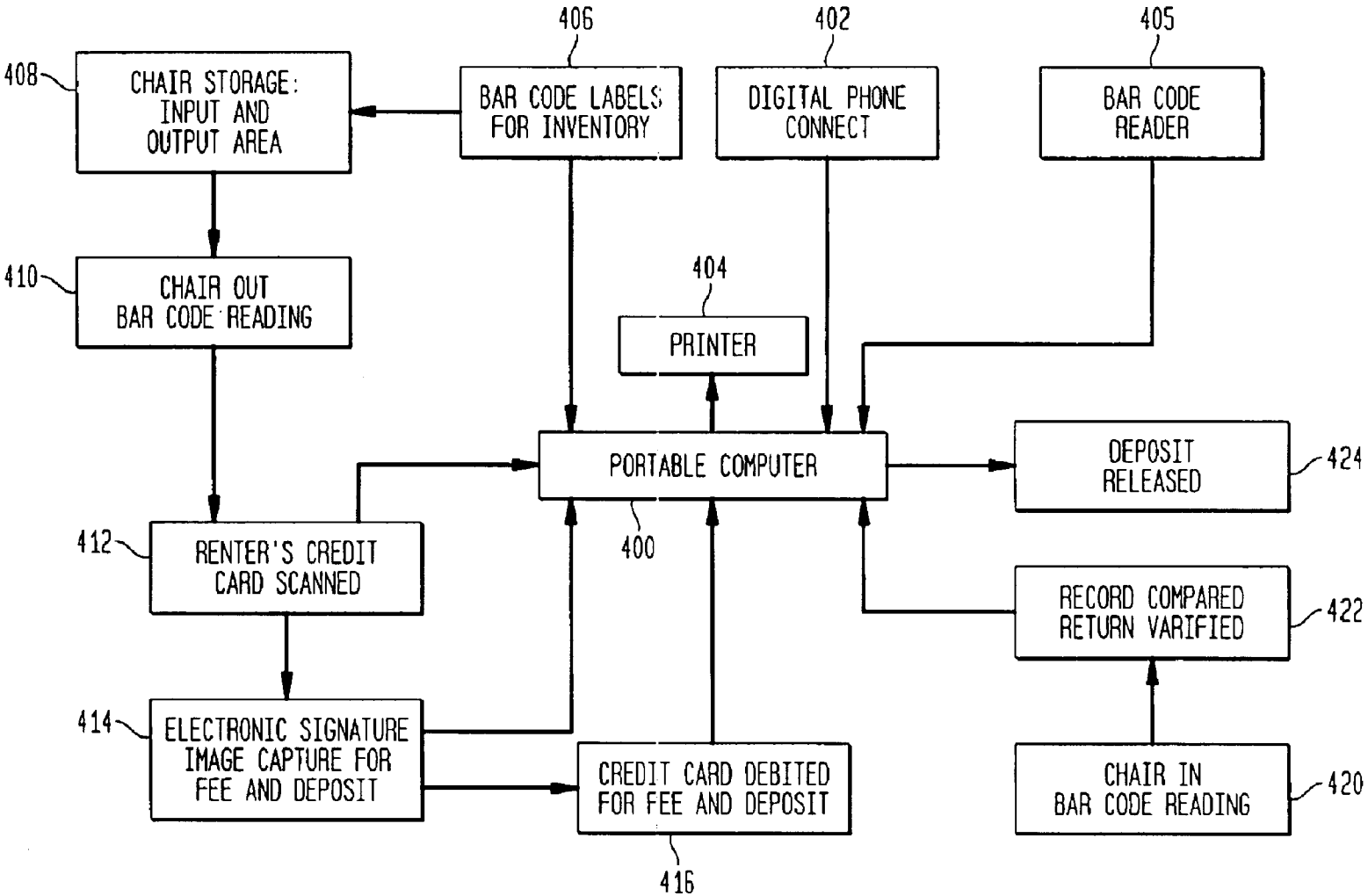
FIG. 4 is a block diagram and flow chart illustration of the novel vending method for the novel bleacher chair.

The vending method illustrated in FIG. 4 employs a portable personal computer 400 connected via a digital phone connection 402 to a credit card processing station or to an internet site for further processing. The portable computer 400 is enabled with a connected printer 404 to print out fee and deposit receipts for renters and an interconnected bar code reader 405 or scanner.

Initiation of the vending method first requires that each bleacher chair comprising an inventory or set be assigned a serial or identification number and subjected to a corresponding bar code labeling step 406. Each identification number for each chair is stored in the computer 400 as an inventory database. The inventory is made available in a secured vending area at a game or event. This step of chair storage 408 in an input and output area means that renter's pick up a bleacher chair and proceed past a check out or chair out and bar code reading step 410 where the bar code of the chair is scanned followed by a step of scanning a credit card 412 of the renter of the chair. A standard electronic signature capture machine and step 414 having a screen and adapted writing pen generates a signature block for the renter's signature authorizing a charge for the rental fee and a deposit for the bleacher chair. The signature image capture machine is connected to the computer 400 along with the output of the credit card scanner via the scanning step 412. A next step 416 requires debiting of the credit card and associated account for the rental fee and deposit. This debit is processed by the computer 400 via the digital phone connect 402.

The method further includes the step 420 of processing the return of a rented bleacher chair 10. In this step the returned bleacher chair is scanned by reading its bar code identification strip. In a next step 422 the scanned data from the returned chair's bar code is compared to the stored rented chair database via the computer 400. Subsequently, the transaction for deposit amount is reversed and cancelled and in a next step 424 the deposit is released.

More specifically, the method of the invention first requires assembly of a group of the chairs 10 made as specified herein and adapted to fit onto a standard bleacher structure such as, for example, bleachers manufactured and supplied by Outdoor Aluminum Company of Geneva, Ala. and described and shown on pgs. 16–17 of its 1999–2000 catalogue. The members of the group are each labeled or tagged with a unique number and representative bar code adapted for bar code scanning. Each of the unique numbers is stored in a magnetic or other personal computer readable medium and the stored numbers represent the available inventory for rental. The method employs an optical laser bar code scanner linked to the computer in conventional manner and operates in the same manner as standard retail store hand held scanners for products bearing bar codes. The computer is equipped with software capable of decoding the bar code appearing on driver's licenses that is representative of the license number. When a portable chair 10 is rented, the renter's driver's license is collected and the bar code of the license and the bar code of the chair 10 are scanned and stored in a file associating the number for the chair and the number for the driver's license. When a chair is returned, its bar code is scanned to identify and display the associated driver's license number. A file storing the driver's license numbers numerically and/or alphabetically is accessed to retrieve the renter's driver's license. The retrieved driver's license is scanned a second time to verify that it is the same license in the associated file. Verification is performed by the computer comparing the secondly scanned bar code output number with the firstly scanned and inputted number. If the numbers match, the computer is programmed to display "MATCH", and then the driver's license is released to the person presenting the rental chair 10.

PARTS LIST

10 Bleacher Chair
12 Bleacher Structure
14 Tiers
16 Bleacher Seating
18 Width
20 Chair Portion
22 Elongated Rod
24 Seat Portion
26 Peripheral Frame (of Seat Portion)
28 Opposed Side (of Seat Portion Frame)
30 Opposed Side (of Seat Portion Frame)
32 Unopposed Side (of Seat Portion Frame)
34 Back Portion
36 Peripheral Frame (of Back Portion)

38 Opposed Side (of Back Portion Frame)
40 Opposed Side (of Back Portion Frame)
42 Unopposed Side (of Back Portion)
44 Seating Surface
46 Interwoven Mesh
48 Plastic Straps
50 Straps (connecting 28 & 30)
52 Straps (connecting 38 & 40)
54 Straps (connecting 32 & 42)
56 Arm Member
58 Arm Member
60 Rearward End (of Arm 56)
62 Rearward End (of Arm 58)
64 Midpoint (of Opposed Side of Back Portion Frame)
66 Midpoint (of Opposed Side of Back Portion Frame)
68 Forward Member
70 Frame (of Forward Member)
72 Opposed Side (of Forward Member Frame)
74 Opposed Side (of Forward Member Frame)
76 Unopposed Side (of Forward Member Frame)
78 Distal End
80 Distal End
82 Forward End (of Arm 56)
84 Forward End (of Arm 58)
86 Midpoint (of Opposed Side 72 of Forward Member Frame)
88 Midpoint (of Opposed Side 74 of Forward Member Frame)
90 Rearward Member
92 Frame (of Rearward Member)
94 Opposed Side (of Rearward Member Frame)
96 Opposed Side (of Rearward Member Frame)
98 Unopposed Side (of Rearward Member Frame)
100 Distal End (of Rearward Member)
102 Distal End (of Rearward Member)
104 Midpoint (Opposed Side 94 of Rearward Member)
106 Midpoint (Opposed Side 96 of Rearward Member)
108 Distal End (of Opposed Side 28 of Seat Portion 24)
110 Distal End (of Opposed Side 30 of Seat Portion 24)
112 Distance
114 Junction (of Forward Member 68 w/ Seat Portion 24)
116 Junction (of Rearward Member 90 w/ Seat Portion 24)
118 Portion
400 portable computer
402 digital phone and connect
404 printer
405 bar code reader
406 bar code labeled inventory
408 chair storage
410 chair out bar code reading step
412 credit card scanning step
414 electronic signature capture step
416 credit debiting step
420 chair in bar code reading step
422 return verification step
424 deposit release step

What is claimed is:

1. In combination with a bleacher structure having tiers of bleacher seating planks of a width W, a collapsible portable disengageable bleacher chair with a plurality of portions including a seat portion having a top and a bottom, said bottom of said seat portion being the only portion of said chair in contact with said bleacher structure, said bottom being juxtaposed on top of one of said seating planks of the bleacher structure, said bleacher chair comprising:

a chair portion comprising:

an scannable transmittable unique identification means for uniquely identifying each said bleacher chair;

an elongated rod;

a seat portion comprising a seat portion frame further comprising a first peripheral frame forming two opposed sides and one unopposed side of a rectangle, and flexibly joined with said elongated rod to form the fourth side thereof;

a back portion comprising a back portion frame further comprising a second peripheral frame forming two opposed sides and one unopposed side of a rectangle, and flexibly joined with said elongated rod to form the fourth side thereof; and, a seating surface;

two lateral arm members, each lateral arm member having a midpoint, the two lateral arm members being positioned outward of said chair portion, one on each side, with each rearward end of each arm member-joined to the opposing sides of said back portion frame of said chair portion approximately at their midpoint;

a forward member comprising a frame forming two opposed forward vertically oriented and forward slanted sides each having a proximal end and a distal end, each having a length F and one unopposed side of a rectangle, with each proximal end of said opposed sides closest to said unopposed side joined to one of the lateral arm members in the proximity of the forward end thereof, with each distal end of said opposed sides farthest from said unopposed side joined by a horizontal bar, and the opposed sides of said forward member joined approximately at their midpoint to the opposing sides of said seat portion frame in the proximity of the unopposed side of said seat portion frame; and, a rearward member comprising a frame forming two opposed rearward vertically oriented and rearward slanted sides each having a length R and one unopposed side of a rectangle, with each distal end of said opposed sides farthest from said unopposed side joined to one of the lateral arm members in the proximity of midpoint of said lateral arm members, and the opposite sides of said rearward member joined at a point proximate to the unopposed side of said rearward member to the opposing sides of said seat portion frame in the proximity of the distal ends of said opposed sides of said seat portion frame farthest from the unopposed side of said seat portion frame, and wherein, a distance D between the juncture of said forward member with said seat portion frame and the juncture of said rearward member with said seat portion frame is greater than the width W of a bleacher seat plank, said seat portion frame resting upon the bleacher seat plank and said bleacher chair supported solely by said bleacher seat plank, and wherein R is substantially less than F, said forward member comprising the frame forming two opposed forward vertically oriented and forward slanted sides each having the length F, the length F representing the length of said forward member, said rearward member comprising the frame forming two opposed rearward vertically oriented and rearward slanted sides each having a length R, the length R representing the length of said rearward member, and wherein the horizontal bar provides a suspended foot rest behind a bleacher seating plank in front of the bleacher seating plank on which the bleacher chair rests.

2. The bleacher seat of claim 1 wherein the rearward member is constructed of separate pieces in which at least the opposing sides are tubular aluminum.

3. The bleacher seat of claim 1 in which the seat surface comprises a tightly interwoven mesh of woven plastic straps, such that, straps connect the opposed sides of said seat portion frame, the opposed sides of said back portion frame, and the unopposed side of said seat portion frame to the unopposed side of side back portion frame across said elongated rod.

4. The bleacher seat of claim 1 in which the seat surface comprises a tightly interwoven mesh of fabric straps, such that, straps connect the opposed sides of said seat portion frame, the opposed sides of said back portion frame, and the unopposed side of said seat portion frame to the unopposed side of side back portion frame across said elongated rod.

5. The bleacher seat of claim 1 in which the seat surface comprises a tightly interwoven mesh of fabric panels, such that, at least one panel connects the opposed sides of said seat portion frame, at least one panel connects the opposed sides of said back portion frame, and at least one panel connects the unopposed side of said seat portion frame to the unopposed side of side back portion frame across said elongated rod.

6. The bleacher seat of claim 1 wherein the seat portion frame is constructed of an integral piece of tubular aluminum.

7. The bleacher seat of claim 1 wherein the back portion frame is constructed of an integral piece of tubular aluminum.

8. The bleacher seat of claim 1 wherein the forward member is constructed of an integral piece of tubular aluminum.

9. The bleacher seat of claim 1 wherein the elongated rod is constructed of metal.

10. A method for the rental of a portable bleacher chair as specified in claim 1, the method being used for an event having bleacher seating, the method being for rental inside said event only to a customer having a unique personal identification and attending said event, which method comprises:

(a) providing an inventory of bleacher chairs at a location proximate to said event, each said bleacher chair comprising a unique identification means for uniquely identifying each said bleacher chair, said identification means being scannable into a computer;

(b) providing a computer means for digitally storing the unique identification means for each bleacher chair;

(c) providing a credit card scanning means for scanning the renter's credit card and obtaining a set of data therefrom when the renter checks out a bleacher chair, the computer means matching the data to the unique identification means for the bleacher chair rented;

(d) the computer means further having a signature capture means for electronically capturing said renters signature authorizing a transaction, the computer means further having a wireless digital phone connection means for sending and receiving credit card data and a printing means for printing a receipt of said transaction;

(e) providing a means for electronically charging and releasing a monetary deposit for said bleacher chair rental; and, (f) releasing the deposit by scanning the unique identification means associated with said bleacher chair upon its return to inventory.

11. The method of claim 10 wherein the unique identification means is attached to the bleacher chair, the bar code being a unique digital number.

12. The method of claim 10 wherein the unique identification means is a bar code and the scanning means is a means for detecting and reading the unique digital number.

13. A method for a rental of a bleacher chair for events having bleacher seating to a customer attending said event, the bleacher seating having a width, which method comprises:

having a supply of bleacher chairs at a convenient location proximate to said event, each said bleacher chair comprising a unique identification means for uniquely identifying each said bleacher chair, the bleacher chair for the method further comprising:

a chair portion comprising:

an elongated rod;

a seat portion comprising a peripheral frame forming two opposed sides and one unopposed side of a rectangle, and flexibly joined with said elongated rod to form the fourth side thereof;

a back portion comprising a peripheral frame forming two opposed sides and one unopposed side of a rectangle, and flexibly joined with said elongated rod to form the fourth side thereof; and, a seating surface;

two lateral arm members positioned outward of said chair portion, one on each side, with each rearward end of each arm member joined to the opposing sides of said back portion frame of said chair portion approximately at their midpoint;

a forward member comprising an aluminum frame forming two opposed sides and one unopposed side of a rectangle, with each distal end of said opposed sides farthest from said unopposed side joined to one of the lateral arm members in the proximity of the forward end thereof, and the opposed sides of said forward member joined approximately at their midpoint to the opposed sides of said seat portion frame in the proximity of the unopposed side of said seat portion frame; and, a rearward member comprising a frame forming two opposed sides and one unopposed side of a rectangle, with each distal end of said opposed sides farthest from said unopposed side joined to one of the lateral arm members in the proximity of the midpoint of said lateral arm members, and the opposed sides of said rearward member joined at a point proximate to the unopposed side of said rearward member to the opposed sides of said seat portion frame in the proximity of the distal ends of said opposed sides of said seat portion frame member farthest from the unopposed side of said seat portion frame, and wherein, the distance between the juncture of said forward member with said seat portion frame and the juncture of said rearward member with said seat portion frame is greater than the width of bleacher seating, such that said seat portion frame can rest upon said bleacher seating, and wherein, the portion of said rearward member extending beyond the junction of said rearward member with said seat portion frame does not contact said bleacher structure in a way which would interfere with the placement of the seat portion frame upon said bleacher seating;

providing a bleacher chair to a customer for the time period of the event upon payment of a rental fee and provision of a security; and, returning said security to said customer upon return of the bleacher chair.

14. In a collapsible, portable lawn chair, said chair comprising:

a chair portion comprising:

a unique identification means for uniquely identifying each said bleacher chair;

an elongated rod;

a seat portion comprising a peripheral frame forming two opposed sides and one unopposed side of a rectangle, and flexibly joined with said elongated rod to form the fourth side thereof;

a back portion comprising a peripheral frame forming two opposed sides and one unopposed side of a rectangle, and flexibly joined with said elongated rod to form the fourth side thereof; and, a seating surface;

two lateral arm members positioned outward of said chair portion, one on each side, with each rearward end of each arm member joined to the opposing sides of said back portion frame of said chair portion approximately at their midpoint;

a forward member comprising a frame forming two opposed sides and one unopposed side of a rectangle, with each distal end of said opposed sides farthest from said unopposed side joined to one of the lateral arm members in the proximity of the forward end thereof, and the opposed sides of said forward member joined approximately at their midpoint to the opposing sides of said seat portion frame in the proximity of the unopposed side of said seat portion frame; and, a rearward member comprising a frame forming two opposed sides and one unopposed side of a rectangle, with each distal end of said opposed sides farthest from said unopposed side joined to one of the lateral arm members in the proximity of the midpoint of said lateral arm members, and the opposite sides of said rearward member joined at a point proximate to the unopposed side of said rearward member to the opposing sides of said seat portion frame in the proximity of the distal ends of said opposed sides of said seat portion frame member farthest from the unopposed side of said seat portion frame member, and wherein, the distance between the juncture of said forward member with said seat portion frame and the juncture of said rearward member with said seat portion frame is greater than a width of a bleacher seat and bleacher support structure, an improvement comprising said seat portion frame juxtaposed upon the bleacher seat, and wherein, the portion of said rearward member extending beyond the junction of said rearward member with said seat portion frame is substantially shortened and avoids contact with the bleacher support structure and wherein said seat portion frame juxtaposed upon the bleacher seat converts the bottom horizontal bar of said forward member into a foot rest.

15. In a combination of a bleacher structure having tiers of bleacher seating planks of a width W, a collapsible portable disengageable bleacher chair with a plurality of portions including a seat portion having a top and a bottom, said bottom of said seat portion being the only portion of said chair in contact with said bleacher structure, said bottom being juxtaposed on top of one of said seating planks of the bleacher structure, said bleacher chair comprising:

a chair portion comprising:

an elongated rod;

a seat portion comprising a seat portion frame further comprising a first peripheral frame forming two opposed sides and one unopposed side of a rectangle, and flexibly joined with said elongated rod to form the fourth side thereof;

a back portion comprising a back portion frame further comprising a second peripheral frame forming two opposed sides and one unopposed side of a rectangle, and flexibly joined with said elongated rod to form the fourth side thereof; and, a seating surface;

two lateral arm members each lateral arm member having a midpoint, the two lateral arm members being positioned outward of said chair portion, one on each side, with each rearward end of each arm member joined to the opposing sides of said back portion frame of said chair portion approximately at their midpoint;

a forward member comprising a frame forming two opposed forward vertically oriented and forward slanted sides each having a proximal end and a distal end, each having a length F and one unopposed side of a rectangle, with each proximal end of said opposed sides closest to said unopposed side joined to one of the lateral arm members in the proximity of the forward end thereof, with each distal end of said opposed sides farthest from said unopposed side joined by a horizontal bar, and the opposed sides of said forward member joined approximately at their midpoint to the opposing sides of said seat portion frame in the proximity of the unopposed side of said seat portion frame; and, a rearward member comprising a frame forming two opposed rearward vertically oriented and rearward slanted sides each having a length R and one unopposed side of a rectangle, with each distal end of said opposed sides farthest from said unopposed side joined to one of the lateral arm members in the proximity of midpoint of said lateral arm members, and the opposite sides of said rearward member joined at a point proximate to the unopposed side of said rearward member to the opposing sides of said seat portion frame in the proximity of the distal ends of said opposed sides of said seat portion frame farthest from the unopposed side of said seat portion frame, and wherein, a distance D between the juncture of said forward member with said seat portion frame and the juncture of said rearward member with said seat portion frame is greater than the width W of a bleacher seat plank, said seat portion frame resting upon the bleacher seat plank and said bleacher chair supported solely by said bleacher seat plank, and wherein R is less than F, said forward member comprising the frame forming two opposed forward vertically oriented and forward slanted sides each having the length F, the length F representing the length of said forward member, said rearward member comprising the frame forming two opposed rearward vertically oriented and rearward slanted sides each having a length R, the length R representing the length of each said rearward member wherein R and F bear a certain ratio relationship to each other, the ratio of R to F approximately 0.667, the improvement comprising an elevated horizontal bar extending between each of said rearward members that provides a suspended foot rest behind a bleacher seating plank and in front of another bleacher seating plank on which the bleacher chair rests.

* * * * *